US005632423A

United States Patent [19]

Louw

[11] Patent Number: 5,632,423

[45] Date of Patent: May 27, 1997

[54] GARMENT HANGERS

[76] Inventor: Henry J. Louw, P.O. Box 125, Plumstead 7800, Capetown, South Africa

[21] Appl. No.: 496,528

[22] Filed: Jun. 29, 1995

[30] Foreign Application Priority Data

Jun. 30, 1994 [ZA] South Africa ..... 94/4702

[51] Int. Cl.[6] ..... A47G 25/48

[52] U.S. Cl. ..... 223/91; 223/85; 223/93

[58] Field of Search ..... 223/85, 88, 91, 223/90, 92, 93; D6/315, 326

[56] References Cited

U.S. PATENT DOCUMENTS

D. 329,755 9/1992 Gouldson ..... D6/326
D. 353,945 1/1995 Louw ..... D6/326
4,623,079 11/1986 Tendrup et al. ..... 223/85
4,828,155 5/1989 Louw ..... 223/85
5,062,556 11/1991 Willpütz ..... 223/96
5,065,916 11/1991 Fildan ..... 223/91

*Primary Examiner*—Bibhu Mohanty
*Attorney, Agent, or Firm*—Ostrolenk, Faber, Gerb & Soffen, LLP

[57] ABSTRACT

A hanger which includes garment support means for retaining garments in the proper position is described. The garment support means includes a connecting part, an arm, a carrier element, a pressing member and a portion of reduced width located on the face of the connecting element. The portion of reduced width, after heating and during cooling, causes the carrier element and the pressing member to bias towards the main bar of the hanger. In addition, a stop formation and raised areas which increase the retention of the garment in the proper position are described.

17 Claims, 5 Drawing Sheets

GARMENT HANGERS

BACKGROUND OF THE INVENTION

1. Field of the Invention

The present invention relates to garment hangers and more particularly, to garment hangers which include a retention means which are especially suited for hanging and retaining garments, particularly undergarments, such as bras and underpants.

2. Description of Related Art

Various types of plastic hangers and garment engaging grips for hanging garments are known. However, these hangers and grips suffer from various defects and disadvantages.

In particular, the engaging grips do not accommodate garments or straps which are very thick or which are made of a slippery or silky material. The grips are often not flexible and therefore, require substantial amounts of pressure to insert the garments.

Finally, these hangers are often used for shipping and displaying garments. Therefore, the garments which are on the hangers are subjected to a large amount of handling which can be rough. However, the known grips do not adequately engage the garment during handling such that the garment is retained in the proper position on the hanger.

Therefore, it is desirable to produce a hanger which can accommodate both thick and thin garments, as well as a variety of materials. In addition, a hanger which can retain such garments in the proper position in the gripping mechanism is desired.

SUMMARY OF THE INVENTION

It is an object of this invention to provide a gripping mechanism on hangers which can accommodate thick and thin garments.

It is a further object of this invention to set forth a grip means which can securely hang garments made from a wide variety of materials, including those which are slippery or silky.

It is also an object of this invention to provide a means for reducing the area between the gripping means and the body of the hanger in order to improve the security with which the hanger retains the garment.

It is a further object of this invention to provide a means which retains the garment in the desired position within the gripping means.

According to the invention, a garment hanger is provided which includes garment support means which are located at the ends of a bar which includes a means for suspending the bar from a support or a rack. The garment support means include a connecting part, an arm, a carrier element and an elongated stiff pressing member. The connecting part is joined at one end to the bar and at the other end to the arm which extends in a direction towards the center of the bar. The arm has a free end which forms a space between the arm and the bar. The carrier element is located at the end of the arm away from the connecting part on the side which faces towards the bar. The elongated stiff pressing member is supported by the carrier element so that the pressing member is biased towards the bar by the arm and so that a part of a garment is receivable in between the pressing member and the bar. In addition, the pressing member is generally in the form of an elongated beam which is substantially centrally and pivotally supported by the free end of the associated carrier element. Finally, a part which is of reduced width in relation to the connecting part is located on the side of the connecting part which faces towards the carrier element. This part of reduced width causes the art to bias the carrier element and the pressing member toward the bar during post-molding shrinkage. This reduced width part results in an increase in the retention of the garment due to decrease in the space between the bar and the pressing member.

In addition, the garment support means can include a raised area along the length of the pressing member and the opposing side of the bar. This raised area increases the retention of the garment between the pressing member and the bar. The use of small raised areas, preferably dots, can be used in addition to or in place of the raised areas in order to further enhance the retention of the garment between the pressing member and the bar.

Further, the garment support means can include a raised area which is positioned on the connection part on the side facing the pressing member and is substantially in alignment with the pressing member. This raised area or "stop formation" maintains the position of the garment between the pressing and the bar by preventing the garment from moving around the end of the pressing member into the space between the pressing member and the arm.

Other features and advantages of the present invention will become apparent from the following description of the invention which refers to the accompanying drawings.

BRIEF DESCRIPTION OF THE DRAWINGS

The invention will now be described by way of example with reference to the accompanying schematic drawings.

DETAILED DESCRIPTION OF THE PREFERRED EMBODIMENTS OF THE INVENTION

Figure 1:
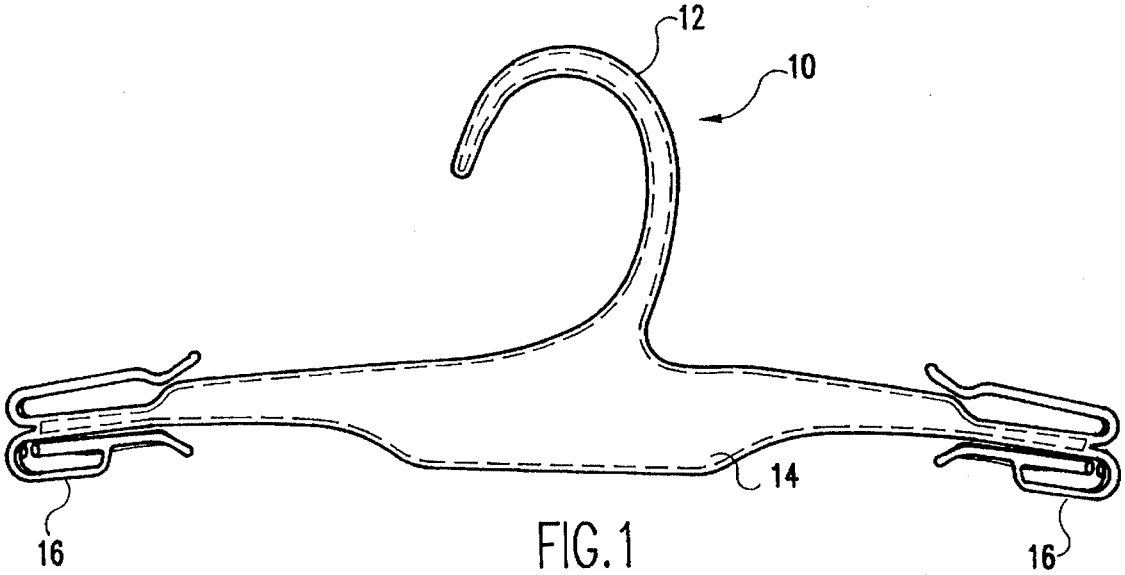
FIG. 1 is a front view of a garment hanger showing a garment support means which includes a stop formation, in accordance with the invention.
Figure 2:
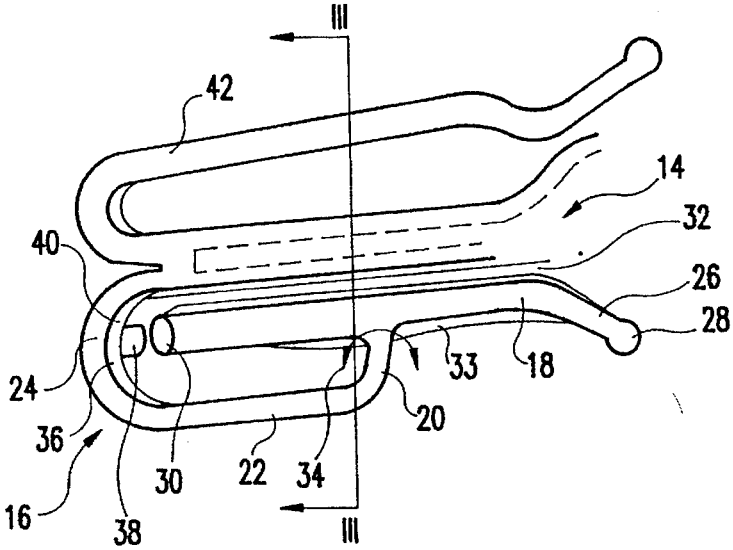
FIG. 2 is a detailed diagram of the garment support means at one end of the bar of the garment hanger, as illustrated in FIG. 1.
Figure 3:
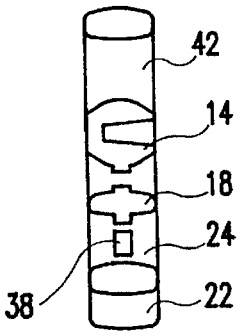
FIG. 3 is a sectional end view as seen along arrows III—III in FIG. 2.
Figure 4:
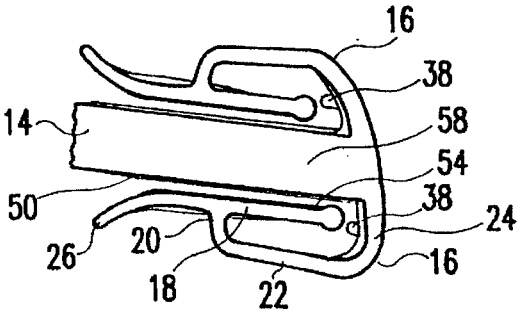
FIGS. 4 through 9 show various embodiments of garment support means which can be provided at the ends of a garment hanger bar.

Referring to FIGS. 1 to 3 of the drawings, the garment hanger, preferably made of plastic material, preferably using injection molding techniques, is generally indicated by reference numeral 10. The garment hanger 10 includes a suspension hook 12 attached at its lower end to an elongated bar 14. The elongated bar 14 carries at its opposite free ends garment support means generally indicated by reference numeral 16.

The garment support means 16 at both ends of the bar are identical and thus, only the left hand garment support means 16 will be described with reference to FIG. 2 and 3.

Referring now to FIGS. 2 and 3, the garment support means 16 includes a stiff garment pressing beam 18 which is preferably, substantially centrally supported by a carrier 20. The carrier is joined by a connection member which has a spring arm 22 leading onto a curved connecting part 24, which in turn is joined onto the bar 14.

Figure 15:
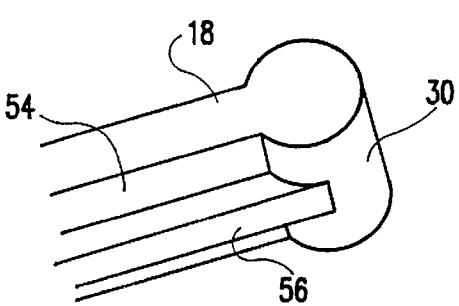
FIG. 15 is a perspective view of the end of one leg of a garment pressing beam as illustrated in FIG. 10.

The pressing beam 18 has an outwardly curved end 26 which can end in a rounded head 28 and at its opposite end can terminate into a curved head 30, which is shown in detail in FIG. 15. A gap 32 is defined between the pressing beam 18 and the bar 14.

The pressing beam 18 further can have a longitudinal fillet or ridge 33 on its side facing away from the bar 14. The purpose of this fillet 33 is to strengthen the beam 18 and to assist it in having sufficient stiffness. In addition, the beam 18 can pivot about the carrier 20, as indicated by reference numeral 34.

The curved part 24 includes on its face 36 a narrowed raised area or fillet or ridge or web 40 which is of reduced width in comparison to the curved part 24. The raised area is shown in detail in FIG. 18. This raised area 40 causes the arm 22 to be pulled upwardly towards the bar 14 during the cooling process after the hanger is removed from the injection molding machine. The raised area 40 reduces the gap which is formed between the clamping surfaces on the bar 14 and the beam 18. The use of a raised area, as described above, enables the outer edges of the curved part and the raised area to cool off rapidly and therefore, support the arm 22 prior to demolding. However, the center, thicker portion is still hot upon demolding and can act to pull the arm towards the bar. The reduced width raised area 40 therefore prevents the hanger from bending out of shape while causing the pressing beam to be moved closer to the bar than is possible during the molding.

Figure 18:
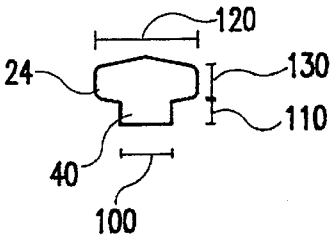
FIG. 18 is a section as seen along arrows XVIII—XVIII in FIG. 10 which illustrates the part of reduced width which is located on the curved connecting part.

Referring further to FIG. 18, it is contemplated that the width 100 and height 110 of the raised area can vary widely and still achieve the desired results. However, in general, the width of the raised area 100 is between approximately 40 and 90% of the width of the curved part 120 and is preferably between approximately 50 and 60% of the width of the curved part 120. In addition, the height of the raised area 110 can be between approximately 20 and 90% of the height of the curved part 130 and is preferably between approximately 60 and 70%.

Further, referring back to FIG. 2, on the inside face 36 of the curved part 24, a raised area or stop element 38 can be provided. This area is preferably a rounded projection, but can be other shapes. It is positioned such that it is substantially in alignment with the pressing beam 18. The stop element is provided to keep the garment in the proper position and prevent the garment from moving around the curved head 30 and into the gap between the arm 22 and the beam.

As stated above, it is preferred that the beam 18 is stiff but pivotable about the carrier 20. The arm 22 and the curved connecting part 24 are flexible so that a spring effect is produced. In other words, if pressure is applied on the beam 18 when inserting a garment, the gap 32 widens, the beam 18 pivots about the carrier 20 according to the position of the force applied on it and the arm 22 and curved part 24 flex to allow the gap 32 to widen as is required. However, due to the resiliency of the arm 22 and the curved part 24, a constant pressure is applied on the beam 18, which in turn presses the garment against the bar 14. As a result of the pivotal support of the beam 18 by way of the carrier 20, the stiff beam 18, which does not bend, is capable of providing a balanced contact and of applying pressure on the full width of a garment after it has been inserted. Thus, the beam 18, and the corresponding part of the hanger bar 14, act as a type of self-aligning vice grip or clamp.

Figure 17:
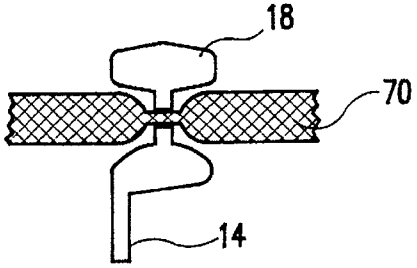
FIG. 17 is a view corresponding to FIG. 16 which shows a garment strap located between the pressing member and the bar.
Figure 16:
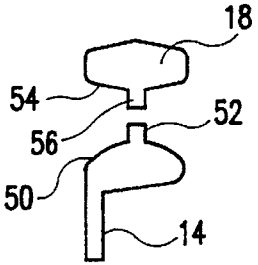
FIG. 16 is a detailed view of a section as seen along arrows XVI to XVI in FIG. 10 which shows the raised area along the width of the bar and the pressing member.

It is contemplated, as shown in detail in FIGS. 15, 16 and 17, that a thin ridge or web 52 can be provided on the edge 50 of bar 14 and opposite thereto, a further thin ridge or web 56 can be provided on the face 54 of beam 18. These pressing or contact ridges 52 and 56 reduce the contact surface thereby increasing the point pressure which is applied to a garment 70 which has been inserted. Since the ridges 52 and 56 are pressed into the garment the resistance to slippage is increased. Therefore, in this clamping zone the linear or horizontal movement of a strap or other part of a garment fitted therein is restricted so that it is prevented from moving or slipping out without reducing the ease with which the garment is inserted. Furthermore, since the ridges or webs 52 and 56 press into the strap or garment material the amount of opening space needed to accommodate the strap or garment and the stress on the spring mechanism are reduced.

Although the pressing member 18 can be a manufactured in a wide variety of widths, it is preferred that the width of the pressing member be approximately the same as the width of the bar 14 and it most preferable that the width of the pressing member be approximately 0.16 inches to 0.2 inches wide. It is preferred that the ridges 52 and 56 are approximately in the range of 10 to 50% of the width of the pressing member 18 and it is most preferable that the ridges 52 and 56 are approximately 10 to 20% of the width of the pressing member 18.

It is also possible to include small raised areas along the edge 50 of the bar 14. The small raised areas or 'micro dots' preferably range in height from approximately 0.01 inches to 0.025 inches and can include from at least four to more than twenty dots. These small raised bumps are preferably positioned in a row in the region opposite beam 18. It is also possible to include similar raised areas along the edge 54 of the beam 18. These raised areas increase the friction between the gripping means and the garment, thereby reducing the slippage of the garment. It is preferred that the raised areas on the bar 14 be offset relative to the raised areas on the beam 18 as this configuration has been found to further facilitate the gripping of the garment.

FIGS. 4 through 9 illustrate various possible configurations and types of garment gripping means. It should be noted that like elements are identified with the same reference numerals as those used in FIGS. 1 through 3.

Figure 5:
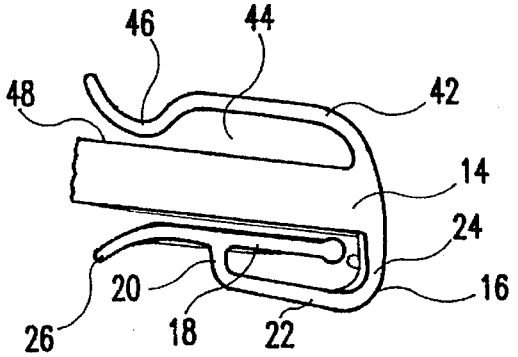

As shown in FIG. 5, on the upper side of the bar 14, a retention arm 42 can be provided. The retention arm defines a gap 44 between it and the bar 14. The arm 42 can have an upwardly curved end 46 abutting against the opposite upper edge 48 of the bar 14.

Figure 6:
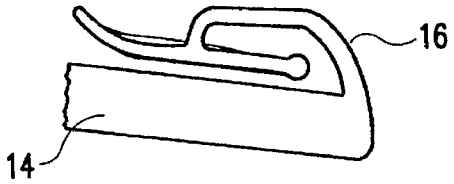
Figure 7:
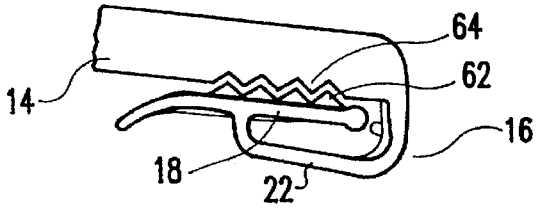
Figure 8:
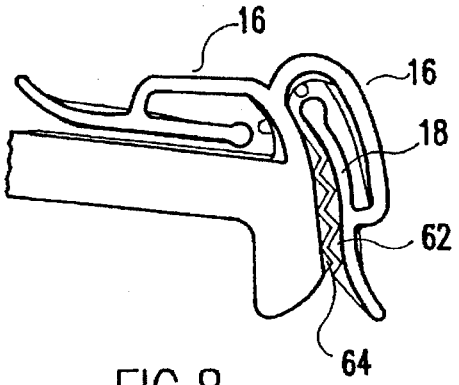
Figure 9:
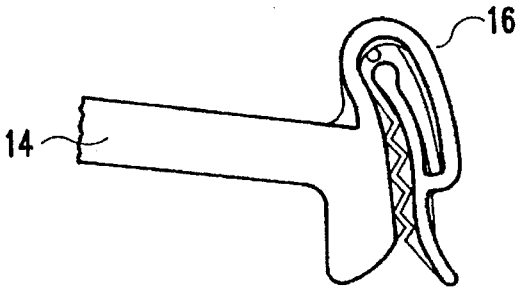

FIG. 6 shows an arrangement where only one garment support means is provided along the upper side of the bar 14.

Figure 10:
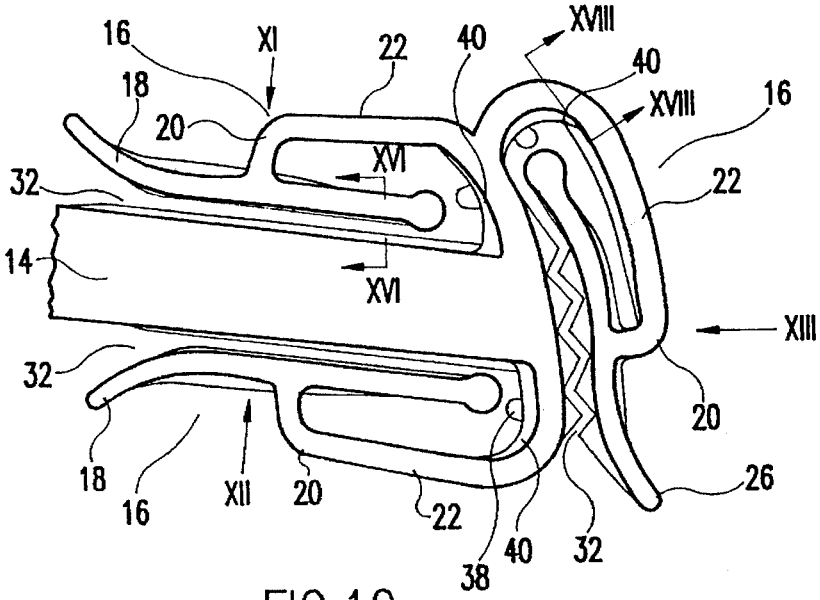
FIG. 10 provides a detailed diagram of a further embodiment of a garment support means which can be provided at the end of a garment hanger bar.

As illustrated in FIGS. 7 through 10, the garment support means 16 can include a serrated formation 62 along the face of the beam 18 and a complementary serrated formation 64 along the face of the bar 14. These serrated formations assist in gripping and retaining a garment which has been placed therein. Various possible combinations of retaining means are provided in FIGS. 7 through 10. In particular, FIG. 10 shows a configuration where at either end of a garment bar 14 three garment support arrangements are provided, namely an upper pressing beam 16, a lower pressing beam 16 and an end pressing beam 16.

Figure 11:
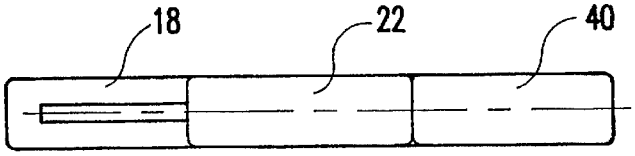
FIG. 11 is a plan view as seen along arrow XI in FIG. 10.
Figure 13:
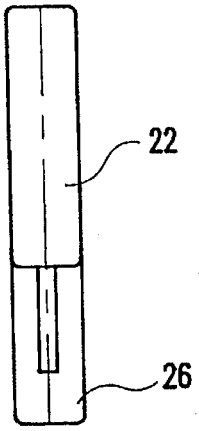
FIG. 13 is an end view of the garment support means as seen along arrow XIII in FIG. 10.
Figure 12:
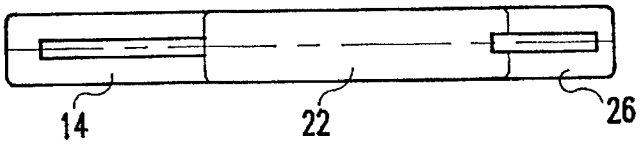
FIG. 12 is a view of the garment support means as seen from below in accordance with arrow XII in FIG. 10.

FIGS. 11, 12 and 13 provide detailed sectional views of the garment support means. In particular, FIG. 11 shows a view looking down on the configuration shown in FIG. 10 which includes the top of the beam 18, the arm 22 of the upper pressing beam and the curved part 40 of the end pressing beam. On the other hand, FIG. 12 provides an illustration of the configuration looking up towards the lower pressing beam and includes the bar 14, the arm 22 of the lower pressing beam and the outwardly curved end 26 of the end pressing beam. Finally, FIG. 13 provides a view looking at the end pressing beam, wherein the arm 22 and the outwardly curved end 26 of the end pressing beam are shown.

Figure 14:
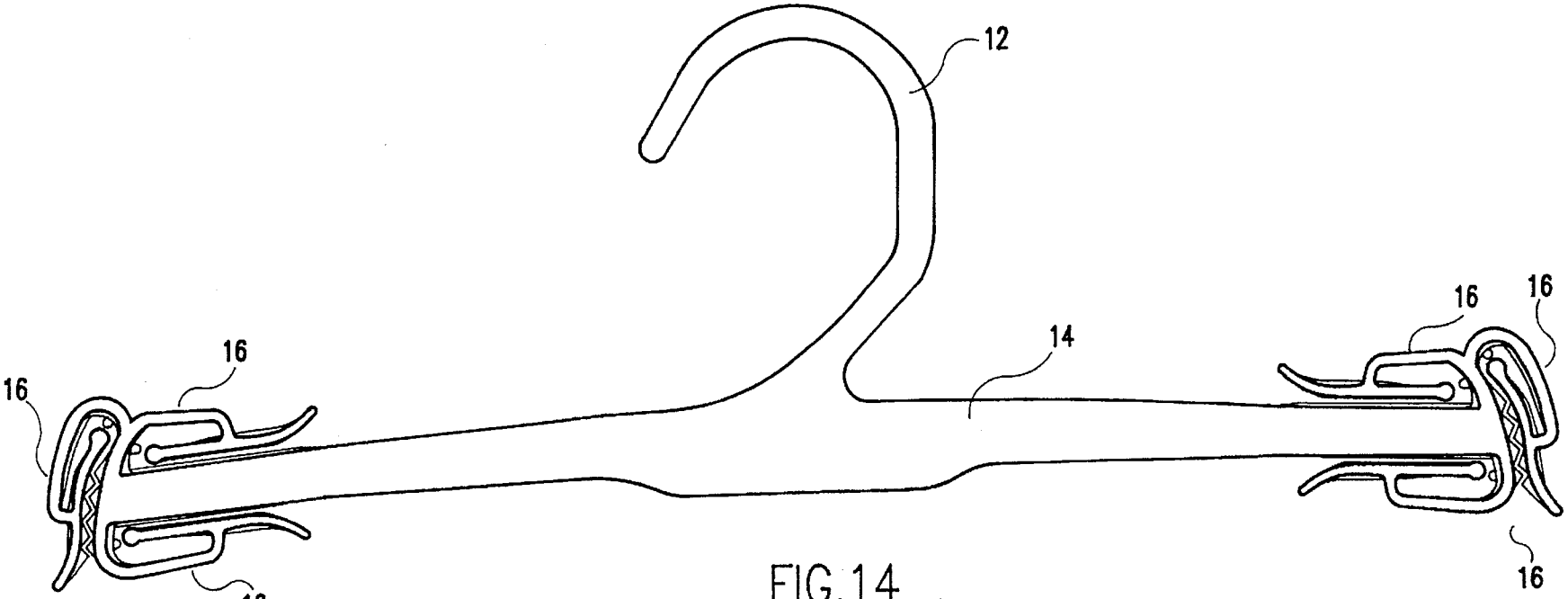
FIG. 14 is a front view of a further embodiment of a garment hanger which includes garment support means as illustrated in FIGS. 10 to 13 at either end of the garment hanger bar in accordance with the invention.

FIG. 14 provides a full view of a hanger which includes the garment support means, as shown in detail in FIG. 10.

Figure 19:
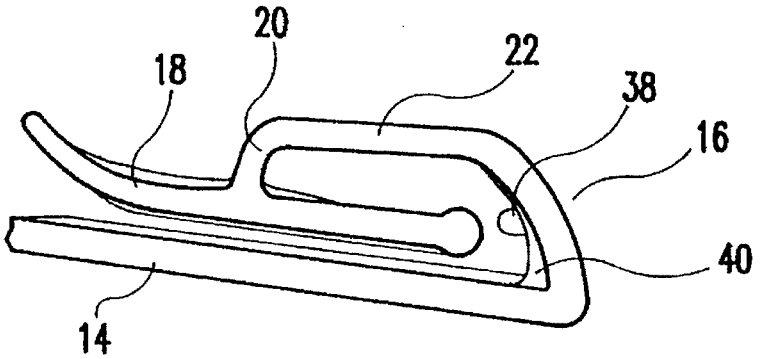
FIGS. 19 to 21 provide examples of the steps for the insertion of a garment into a garment support means in accordance with the invention.
Figure 20:
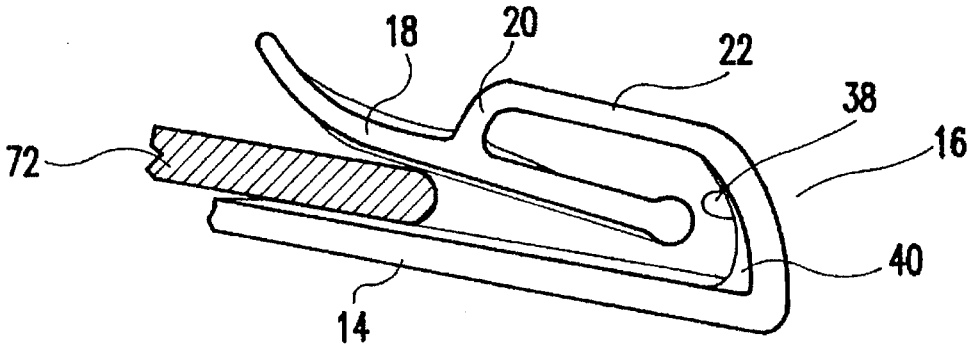
Figure 21:
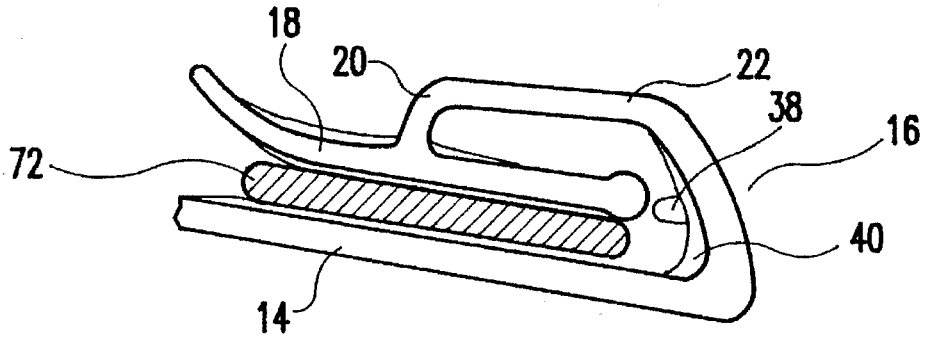

Referring now to FIGS. 19 through 21, the steps of the insertion of a garment into a garment support means, in accordance with the invention, are illustrated.

FIG. 19 shows the condition of rest with no garment inserted.

In FIG. 20, a garment 72 is inserted. The pivoting of the beam 18 around the carrier 20 is clearly visible and a wide entry opening or throat is shown.

In FIG. 21, the garment or strap 72 is fully inserted. The beam 18 abuts against the garment 72 so that it is substantially parallel to the bar 14.

Although the present invention has been described in relation to particular embodiments thereof, many other variations and modifications and other uses will become apparent to those skilled in the art.

I claim:

1. A garment hanger, comprising:

an elongated bar having two opposite ends;

suspension means for suspending said bar from a support; and at least one garment support means at each of said opposite ends of the bar for supporting garments from said hanger, wherein each of said garment support means comprises:

a connecting part with a first end and a second end, wherein said connecting part is joined at said first end to and extending from the associated end of said bar;

an arm, wherein said connecting part is joined at said second end onto said arm extending in a direction towards the center of said bar, said arm having a free end disposed so that a space is formed between said arm and said bar;

a carrier element being located at the end of said arm away from said connecting part on the side thereof facing towards said bar;

an elongated pressing member being supported by said carrier element so that said pressing member is biased towards said bar by said arm and so that a part of a garment is receivable in between said pressing member and said bar and wherein each pressing member is in the form of an elongated beam which is substantially centrally and pivotally supported by the free end of the associated carrier element; and a part of reduced width relative to said connecting part extending on one side of said connecting part facing towards said carrier element, wherein after heating and upon cooling, said part of reduced width causes said arm to bias said carrier element and said pressing member towards said bar.

2. A hanger, as recited in claim 1, wherein said pressing member has a curved part at its end facing towards the center of the bar, the curved part being directed away from the bar.

3. A hanger, as recited in claim 1, wherein said pressing member and said carrier member are of substantially T-shape.

4. A hanger, as recited in claim 1, wherein said pressing member abuts against said bar.

5. A hanger, as recited in claim 1, wherein said garment support means is a first set of garment support means and is located at each of said bar on a side of said bar opposite to said suspension means.

6. A hanger, as recited in claim 5, further comprising a second set of garment support means, one of said second set of garment support means being located on each end of said bar opposite to said first garment support means.

7. A hanger, as recited in claim 6, further comprising a third set of garment support means, one of said third set being located at each end of said bar, and having a downwardly directed arm and pressing member.

8. A hanger, as recited in claim 7, wherein facing surfaces of said bar and said pressing member of said third set of garment support means include complementary serrated formations.

9. A hanger, as recited in claim 1, wherein facing surfaces of said bar and said pressing member include raised areas.

10. A hanger, as recited in claim 9, wherein said raised areas are ridges.

11. A hanger, as recited in claim 1, wherein said connection part further includes a stop formation on a side facing said pressing member, wherein said stop formation is substantially aligned with said pressing member.

12. A hanger, as recited in claim 1, wherein said connection part further includes a stop formation on a side facing said pressing member, wherein said stop formation includes a raised area substantially aligned with said pressing member and wherein said stop formation reduces the space between said connecting part and an end of said pressing member.

13. A garment hanger, comprising:

an elongated bar having two opposite ends;

suspension means for suspending said bar from a support; and at least one garment support means at each of said opposite ends of the bar for supporting garments from said hanger, wherein each of said garment support means comprises:

a connecting part with a first end and a second end, wherein said connecting part is joined at said first end to and extending from the associated end of said bar;

an arm, wherein said connecting part is joined at said second end onto said arm extending in a direction towards the center of said bar, said arm having a free end disposed so that a space is formed between said arm and said bar;

a carrier element being located at the end of said arm away from said connecting part on the side thereof facing towards said bar;

an elongated pressing member being supported by said carrier element so that said pressing member is biased towards said bar by said arm and so that a part of a garment is receivable in between said pressing member and said bar and wherein each pressing member is in the form of an elongated beam which is substantially centrally and pivotally supported by the free end of the associated carrier element; and a stop formation on said connecting part on a side facing said pressing member, wherein said stop formation is substantially aligned with said pressing member.

14. A hanger, as recited in claim 13, wherein said stop formation reduces the space between said connecting part and an end of said pressing member.

15. A garment hanger, comprising:

an elongated bar having two opposite ends;

suspension means for suspending said bar from a support; and at least one garment support means at each of said opposite ends of the bar for supporting garments from said hanger, wherein each of said garment support means comprises:

a connecting part with a first end and a second end, wherein said connecting part is joined at said first end to and extending from the associated end of said bar;

an arm, wherein said connecting part is joined at said second end onto said arm extending in a direction towards the center of said bar, said arm having a free end disposed so that a space is formed between said arm and said bar;

a carrier element being located at the end of said arm away from said connecting part on the side thereof facing towards said bar;

an elongated pressing member being supported by said carrier element so that said pressing member is biased towards said bar by said arm and so that a part of a garment is receivable in between said pressing member and said bar and wherein each pressing member is in the form of an elongated beam which is substantially centrally and pivotally supported by the free end of the associated carrier element; and a part of reduced width relative to said connecting part extending on one side of said connecting part facing towards said carrier element, for causing said arm to bias said carrier element and said pressing member towards said bar.

16. A garment hanger, comprising:

an elongated bar having two opposite ends;

a suspender for suspending said bar from a support; and at least one garment support at each of said opposite ends of the bar for supporting garments from said hanger, wherein each of said garment supports comprises:

a connecting part with a first end and a second end, wherein said connecting part is joined at said first end to and extending from the associated end of said bar;

an arm, wherein said connecting part is joined at said second end onto said arm extending in a direction towards the center of said bar, said arm having a free end disposed so that a space is formed between said arm and said bar;

a carrier element being located at the end of said arm away from said connecting part on the side thereof facing towards said bar;

an elongated pressing member being supported by said carrier element so that said pressing member is biased towards said bar by said arm and so that a part of a garment is receivable in between said pressing member and said bar and wherein each pressing member is in the form of an elongated beam which is substantially centrally and pivotally supported by the free end of the associated carrier element; and a part of reduced width relative to said connecting part extending on one side of said connecting part facing towards said carrier element, for causing said arm to bias said carrier element and said pressing member towards said bar.

17. A garment hanger, comprising:

an elongated bar having two opposite ends;

a suspender for suspending said bar from a support; and at least one garment support at each of said opposite ends of the bar for supporting garments from said hanger, wherein each of said garment supports comprises:

a connecting part with a first end and a second end, wherein said connecting part is joined at said first end to and extending from the associated end of said bar;

an arm, wherein said connecting part is joined at said second end onto said arm extending in a direction towards the center of said bar, said arm having a free end disposed so that a space is formed between said arm and said bar;

a carrier element being located at the end of said arm away from said connecting part on the side thereof facing towards said bar;

an elongated pressing member being supported by said carrier element so that said pressing member is biased towards said bar by said arm and so that a part of a garment is receivable in between said pressing member and said bar and wherein each pressing member is in the form of an elongated beam which is substantially centrally and pivotally supported by the free end of the associated carrier element; and a stop formation on said connecting part on a side facing said pressing member, wherein said stop formation is substantially aligned with said pressing member.

* * * * *